United States Patent [19]

Crutchfield

[11] Patent Number: 4,976,355

[45] Date of Patent: Dec. 11, 1990

[54] WASTE BASKET SIMULATED AS A BASKETBALL HOOP AND NET

[75] Inventor: E. Bryant Crutchfield, Dayton, Ohio

[73] Assignee: The Mead Corporation, Dayton, Ohio

[21] Appl. No.: 503,589

[22] Filed: Mar. 23, 1990

[51] Int. Cl.[5] ..... B65D 5/10

[52] U.S. Cl. ..... 206/457; 229/117; 229/907; 206/491

[58] Field of Search ..... 206/457, 491; 229/117, 229/907

[56] References Cited

U.S. PATENT DOCUMENTS

| | | | |
|---|---|---|---|
| 3,455,498 | 7/1969 | Gadiel | 229/907 X |
| 4,600,102 | 7/1986 | Avila | 206/457 |
| 4,657,176 | 4/1987 | Matsubava | 229/907 X |

*Primary Examiner*—William I. Price

*Attorney, Agent, or Firm*—Biebel, French & Nauman

[57] ABSTRACT

A waste basket simulating a basketball net comprises a square container constructed from a blank of corrugated paperboard in such manner that it can be manually erected from a substantially flat, collapsed condition and vice versa. The waste basket includes a square cover which fits over the top of the container and has therein a circular opening matching the graphic representation of a basketball net on each of the four sides of the container.

3 Claims, 3 Drawing Sheets

WASTE BASKET SIMULATED AS A BASKETBALL HOOP AND NET

BACKGROUND OF THE INVENTION

Waste baskets have through the years been constructed of a variety of materials, e.g. wood, plastic and metal, and in a variety of shapes, e.g. round, oblong, and polygonal, including square. So far as the present inventor knows, however, the consistent conventional practice has been either to have no cover on a waste basket, or to provide a cover which must be removed or otherwise opened in order to provide access to its interior.

It is a common practice for the user of a waste basket to throw waste material into the basket, often from a substantial distance, which of course requires that the basket not be covered. It is also a common practice, especially as a reflection of the increasing popularity of the game of basketball in recent years, for the user of a waste basket to pretend that it is a basketball net and to throw waste material toward it with a looping trajectory simulating the flight of a basketball. This course also requires that the waste basket be uncovered.

SUMMARY OF THE INVENTION

The primary object of the present invention is to provide a waste basket which will more closely resemble a basketball net than any conventional waste basket, and a specific object of the invention is to provide such a waste basket which has on the sides thereof a graphic representation of a basketball net.

It is also an object of the invention to provide such a waste basket consisting of a square container provided with a removable cover which is square to fit the top of the container but has a circular hole therethrough that simulates the hoop of a basketball net, and a special object of the invention is to provide such a container constructed of corrugated paperboard in such manner that it can be folded flat for packaging and shipping purposes but can be quickly erected for use.

Other objects and advantages of the invention, and the means by which they are achieved and provided, will be apparent from or pointed out the course of the description of a preferred embodiment of the invention which follows.

DESCRIPTION OF THE PREFERRED EMBODIMENT

Figure 1:
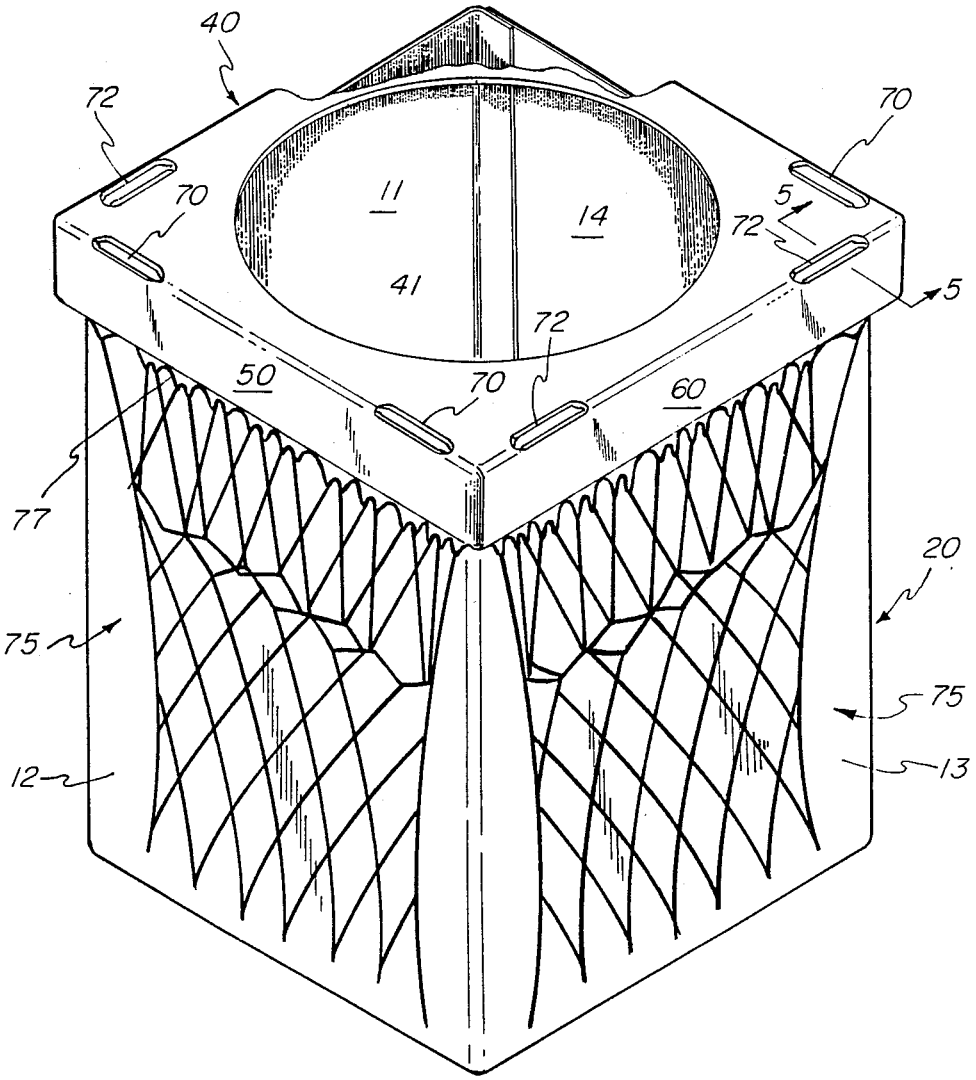
FIG. 1 is a perspective view, partly broken away, showing a waste basket embodying the invention.

The main component of the waste basket shown in FIG. 1 is a body formed of a single blank 10 of corrugated paperboard consisting of four side panels 11, 12, 13 and 14 hingedly connected together along their side edges through fold lines 15. A flap 16 is connected with the outer side edge of the panel 11 through a fold line 17, and when the blank is assembled to form a square container, the flap 16 fits inside and is glued to the corresponding outer edge portion of the panel 14 at the other end of the blank 10 so that the blank can be erected to form a container 20 having an open top of square configuration.

The blank 10 includes panels which cooperate to provide the erected container 20 with a bottom, and which may be of any conventional type. For example, the bottom may be formed by panels hinged to the side panels and coated with two different pressure sensitive adhesives each of which will adhere to the other but not to itself. Preferably, however, the bottom panels are configured and interconnected to provide the container 10 with "an automatic bottom" which snaps into locked condition when the container is manually erected to its square configuration, but which can be manually unlocked to return the container to flat condition, reference being made in this connection to British Patent No. 345,682 of 1931 for a detailed description of such an "automatic" bottom.

More specifically, each of the side panels 11–14 has one of a corresponding set of bottom panels 21–24 extending from a fold line 25 along the bottom edge thereof. Each of the bottom panels 21 and 23 is essentially rectangular in shape, but a triangular portion 30 including one corner of each thereof is connected with the remainder of the panel through a fold line 31. Each of the other two panels 22 and 24 has one end edge 33 beveled, and the other outer corner is cut away to provide a rounded edge 35.

Figure 2:
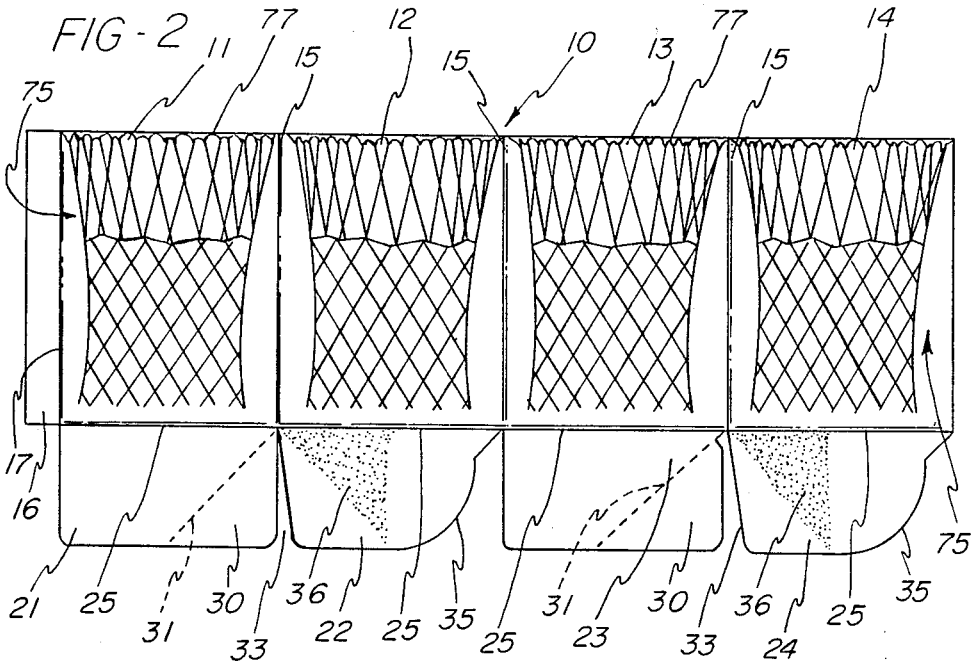
FIG. 2 illustrates the blank of corrugated paperboard from which the body of the waste basket shown in FIG. 1 is constructed.
Figure 3:
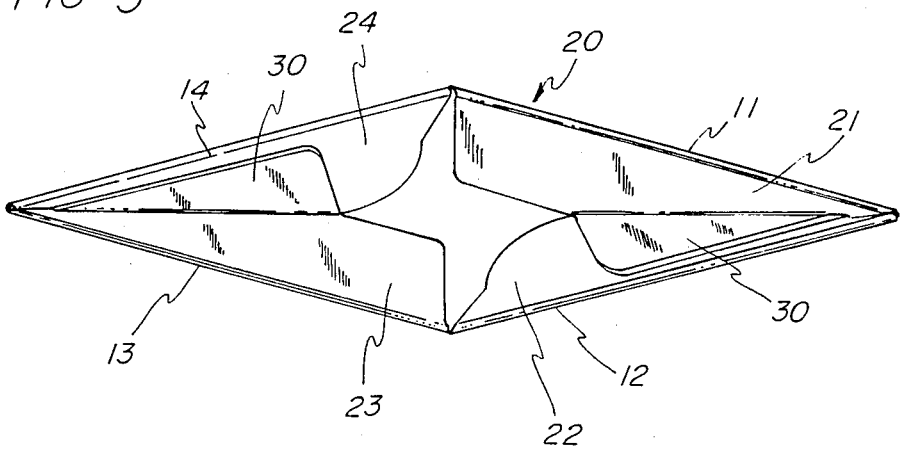
FIG. 3 is an elevational view of the bottom end of the container shown in FIG. 1 in partially erected condition, the view being on a larger scale than FIG. 2.

When the blank 10 is being converted into a collapsible container 20 by gluing the flap 16 to the side panel 14, the flap portions 30 of the bottom panels 21 and 23 are also glued to the respectively adjacent bottom panels 22 and 24, the areas 36 to which the flaps 30 are glued being cross-hatched in FIG. 2. At the same time, all of the bottom panels 21–24 are folded inwardly of the container, while the flaps 30 are folded in the opposite direction.

Figure 4:
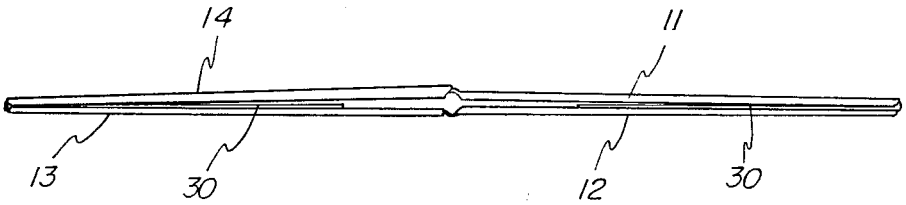
FIG. 4 is an elevational view of the bottom end of the container in FIG. 1 illustrating the manner in which it can be folded flat for storage or shipment.

When the assembled blank is erected from a flat, folded condition as shown in FIG. 4, the interaction of the bottom panels is such that as the blank reaches its fully erected square configuration, the bottom panels snap into and lock the desired bottom-forming relation, as described in the above British Patent No. 345,682. The waste basket is then completed by addition of its cover 40, which is constructed as now described.

Figure 5:
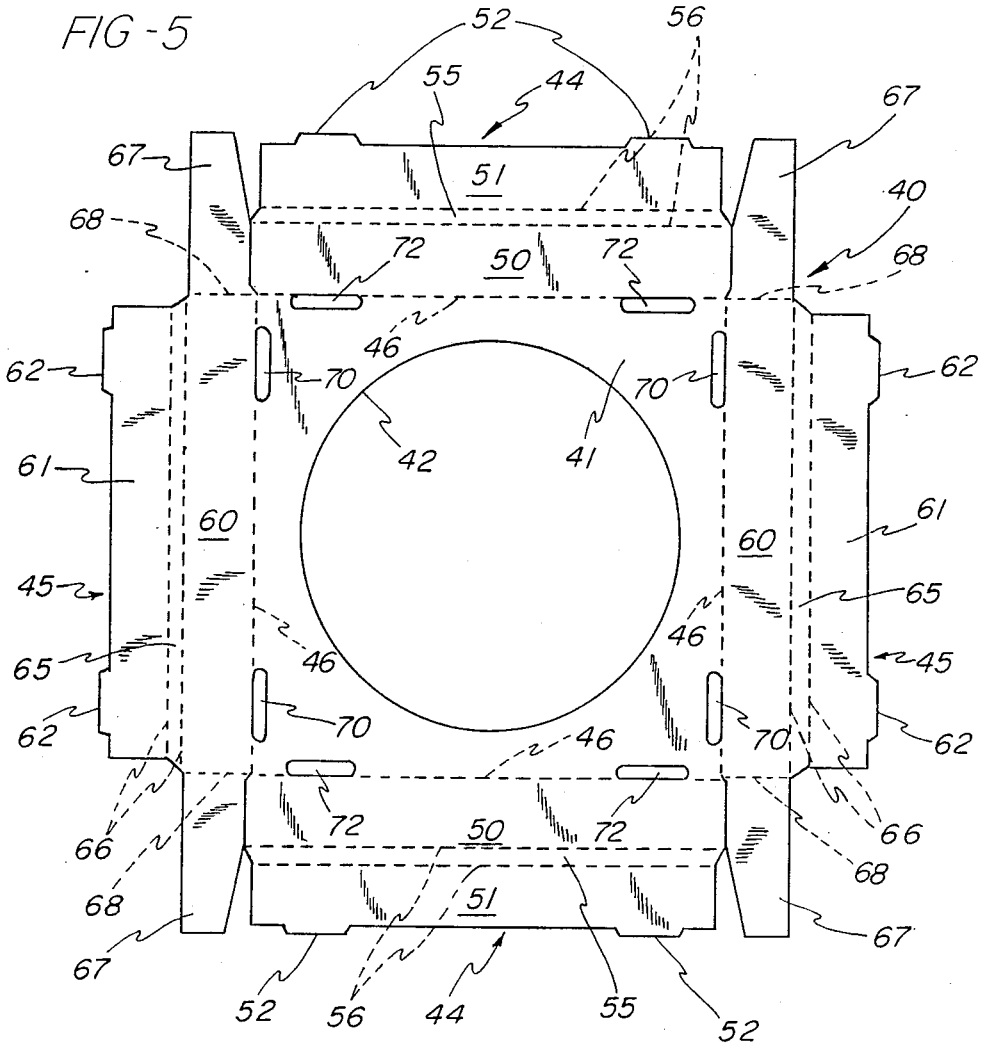
FIG. 5 illustrates the blank from which the cover of the waste basket shown in FIG. 1 is constructed.
Figure 6:
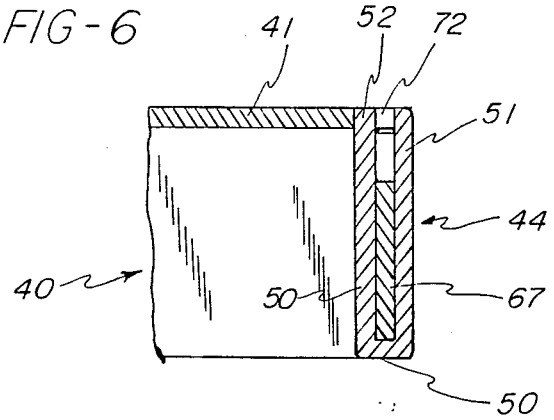
FIG. 6 is an enlarged fragmentary section taken on the line 6—6 in FIG. 1 to show details of the cover.

Referring particularly to FIGS. 5 and 6, the cover 40 consists of a blank of corrugated paperboard having a square central portion 41 from which a centrally located circular portion is removed to provide a circular opening 42 therethrough. A panel 44 extends from each of one pair of opposed sides of the square portion 41, and a differently configured panel 45 extends from each of the other pair of opposed sides of the central portion 41. A fold line 46 is provided between the central portion 41 of the blank and each of the panels 44 and 45 extending therefrom.

Each of the panels 44 comprises an inner portion 50 bordering the fold line 46, an outer portion 51 which includes a tab 52 adjacent each end of the outer edge thereof, and a narrow central portion 55 having fold lines 56 along each edge thereof and which is approximately three times as wide as the thickness of the paperboard stock. Each of the panels 45 similarly comprises an inner portion 60 bordering the adjacent fold line 46, an outer portion 61 having tabs 62 along its outer edge, and a narrow central portion 65 having a fold line 66 along each edge thereof. In addition, the inner panel portion 60 has a flap 67 extending from a fold line 68 at each end thereof.

In order to erect the cover 40, the two panels 45 are first folded about the fold lines 46 to a right-angled relation with the central portion 41, and their outer portions 61 are then folded around both of the fold lines 66 into parallel relation with their portions 60 and are locked in that position by inserting the tabs 62 in the complementary slots 70 in panel portion 41 just inside the fold lines 46. The panels 44 are then similarly folded about the fold lines 46 and the fold lines 56 so that each of the flaps 67 is confined between the adjacent panel portions 50 and 51, with assembly being completed by insertion of the tabs 52 in their complementary slots 72.

In order to complete the desired close visual resemblance between the waste basket of the invention and a basketball net, a graphic representation of a side elevation of the fabric portion of a basketball net is reproduced on each of the side panels 11–14, as shown at 75 in FIGS. 1 and 2. The hooks 77 by which a basketball net is conventionally hung from the associated metal rim are included in the graphics, and preferably are located to appear just under the cover 40 to provide the illusion that the rim is inside the cover or is included in the side of the cover. These graphics combine with the circular opening 41 in the cover 40 to produce the desired visual effect of the appearance of basketball net as viewed from any vantage point, and the cover itself can be colored to blend with the representation of the net or otherwise to provide a harmonious background for the graphics.

While the articles herein described constitute preferred embodiments of this invention, it is to be understood that the invention is not limited to these precise articles, and that changes may be made therein without departing from the scope of the invention which is defined in the appended claims.

What is claimed is:

1. A waste basket comprising:

(a) a main body formed of a single blank of corrugated paperboard consisting of four side panels of the same dimensions integrally connected through fold lines in side-by-side relation, (b) said blank having a flap on one end thereof secured to the opposite end thereof whereby said blank may be erected to form a container having an open top of square configuration and also folded to substantially flat condition, (c) said blank also including a bottom panel extending from the bottom edge of each said side panel which cooperates with the other said bottom panels to close the bottom of said erected container, (d) a cover of corrugated paperboard of square configuration proportioned to fit over the top of said erected container, (e) said cover having a centrally located opening therethrough of circular configuration, and (f) each of said panels having thereon a graphic representation of a basketball net which cooperates with said circular opening in said cover to provide said waste basket with the appearance of a basketball net.

2. A waste basket as defined in claim 1 characterized in that said blank may be erected by hand and includes means for automatically securing said bottom panels together and maintaining said main body in an erected condition when assembled by hand.

3. A waste basket as defined in claim 2 wherein alternate said bottom panels are presecured together to provide said container with an automatic bottom in response to movement of said side panels to right angled relation.

* * * * *